US007988410B1

(12) United States Patent
Liang

(10) Patent No.: US 7,988,410 B1
(45) Date of Patent: Aug. 2, 2011

(54) BLADE TIP SHROUD WITH CIRCULAR GROOVES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 925 days.

(21) Appl. No.: 11/986,039

(22) Filed: Nov. 19, 2007

(51) Int. Cl.
*F01D 25/12* (2006.01)

(52) U.S. Cl. ..... 415/173.1; 415/115; 415/173.4; 415/176; 415/178

(58) Field of Classification Search ..... 415/115, 415/116, 173.1, 173.4, 176, 178
See application file for complete search history.

(56) References Cited

U.S. PATENT DOCUMENTS 3,365,172 A * 1/1968 Howald et al. ..... 415/117
4,013,376 A * 3/1977 Bisson et al. ..... 415/117
4,017,207 A * 4/1977 Bell et al. ..... 415/115
4,222,706 A * 9/1980 Ayache et al. ..... 415/116
4,466,772 A 8/1984 Okapuu et al.
4,714,406 A 12/1987 Hough
5,375,973 A * 12/1994 Sloop et al. ..... 415/173.1
5,762,470 A 6/1998 Gelmedov et al.
6,155,778 A 12/2000 Lee et al.
6,231,301 B1 5/2001 Barnett et al.
6,234,747 B1 5/2001 Mielke et al.
6,331,098 B1 * 12/2001 Lee ..... 416/97 R
6,499,940 B2 12/2002 Adams
6,582,189 B2 6/2003 Irie et al.
6,905,302 B2 6/2005 Lee et al.
7,665,955 B2 * 2/2010 Liang ..... 415/115
7,670,108 B2 * 3/2010 Liang ..... 415/173.1

* cited by examiner

*Primary Examiner* — Igor Kershteyn
(74) *Attorney, Agent, or Firm* — John Ryznic

(57) ABSTRACT

A blade tip shroud segment for a gas turbine engine in which the shroud segment is cooled and sealed using a combination of vortex cooling air flow and cooling air discharge film cooling. The shroud segment includes a row of vortex chambers formed within the shroud segment and a row of circumferential circular grooves formed on the hot gas flow surface of the shroud segment, where each groove is connected to a vortex chamber through a slot. Cooling air is to the vortex chambers from individual cooling air feed slots or through inter-linking channels connecting adjacent vortex chambers.

26 Claims, 4 Drawing Sheets

View A-A

BLADE TIP SHROUD WITH CIRCULAR GROOVES

BACKGROUND OF THE INVENTION

1. Field of the Invention

The present invention relates generally to a gas turbine engine, and more specifically to a blade tip shroud with cooling and sealing.

2. Description of the Related Art Including Information Disclosed Under 37 CFR 1.97 and 1.98

In a gas turbine engine, a high temperature gas flow is passed through a turbine to convert the energy from the gas flow into mechanical work to drive the compressor and, in the case of an industrial gas turbine (IGT) engine, to drive an electric generator. The turbine is designed to operate under the highest temperature sustainable since the efficiency of the engine is directly proportional to the temperature of the gas flow entering the turbine. Thus, higher turbine inlet temperatures result in higher efficiencies.

One method of allowing for higher turbine inlet temperature is to provide for maximum cooling of the stator vanes and rotor blades in the turbine, especially the first stage airfoils since these are exposed to the highest temperature. Adequate cooling of the turbine parts also increases the life of these parts, which is very important in an IGT because the long service life is a major factor.

Another important design factor is the leakage flow that passes through the turbine such as the gap formed between the rotor blade tips and the outer shroud surface. Reducing the blade tip leakage not only improves the turbine efficiency but also reduces the heat load that results on the blade tip and the shroud from the passing hot gas flow. Hot spots can occur that will damage turbine parts and reduce the efficiency. Damaged turbine parts such as rotor blades and outer shroud segments shorten engine life. High temperature turbine blade tip shroud heat load is a function of the blade tip section leakage flow. A high leakage flow will induce a high heat load onto the blade tip and shroud. Therefore, blade tip shroud cooling and sealing have to be addressed as a single problem.

In the prior art, a grooved turbine tip shroud includes a plurality of grooves within a range of 90 to 130 degrees angle relative to the shroud backing structure which extends into the flow path for the entire axial length of the blade outer air seal (BOAS). The main purpose in the use of a grooved tip shroud in the blade design is to reduce the blade tip leakage and also to provide for rubbing capability for the blade tip. One prior art method of reducing blade tip leakage is shown in U.S. Pat. No. 4,466,772 issued to Okapuu et al on Aug. 21, 1984 and entitled CIRCUMFERENTIALLY GROOVED SHROUD LINER which discloses a stationary shroud surrounding a rotor with radially extending blades in which the shroud includes a plurality of spaced apart lands that define grooves. The shroud grooves in this patent are formed with straight sealing teeth and un-cooled. One major problem with this design is the formation of secondary hot gas flow recirculation within the grooves. Because of the increase in the turbine inlet temperature in the past few years, cooling for the type of blade tip shroud becomes necessary.

Another prior art reference, U.S. Pat. No. 6,155,778 issued to Lee et al on Dec. 5, 2000 and entitled RECESSED TURBINE SHROUD discloses a turbine blade tip shroud having a plurality of recesses 62 disposed in the panel inner surface of the shroud and extending only in part into the panel radially outwardly toward the panel outer surface. These recesses are provided for reducing surface area exposed to the blade tips so that during a blade tip rub with the shroud, reduced rubbing of the blade tips with the shroud occurs for correspondingly decreasing frictional heat in the blade tip. Reduced frictional heat permits the available cooling of both the blade tip and the turbine shroud to reduce the temperature thereof other than it would be with a continuous conventional shroud without the surface interruptions provided by the recesses. Cooling holes also supply cooling air from above the shroud and into the recesses for internal convection cooling as well as providing film cooling of the shroud inner surface. In the Lee et al invention, the cooling holes are straight and therefore the convection cooling capability is low.

BRIEF SUMMARY OF THE INVENTION

It is an object of the present invention to provide for a turbine blade tip shroud with a reduced hot gas side convection heat load area and more cooling side convective cooling surface that the cited prior art references.

It is another object of the present invention to provide for a turbine blade tip shroud in which the cooling circuit can be independently designed based on the local heat load and aerodynamic pressure loading conditions on the BOAS.

It is another object of the present invention to provide for a turbine blade tip shroud with and improve service life.

A turbine blade tip shroud having an inner surface with a plurality of rows of circular circumferential grooves that provide low levels of blade tip rub, and in which the shroud includes multiple vortex chambers are connected between cooling air supply holes and the grooves to provide a cooling air flow path within the shroud in which cooling air enters into the vortex chamber and flows in a circular path, and then flows into the circular grooves to be discharged into the tip gap and reduce the resulting vena contractor in the leakage flow. Various embodiments of the shroud with vortex flow chambers arranged between inlet cooling holes and the circular grooves on the inner shroud surface are proposed that provide increased cooling capability for the blade tips shroud and provide better sealing between the blade tips and the shroud over the cited prior art designs.

DETAILED DESCRIPTION OF THE INVENTION

Figure 1:
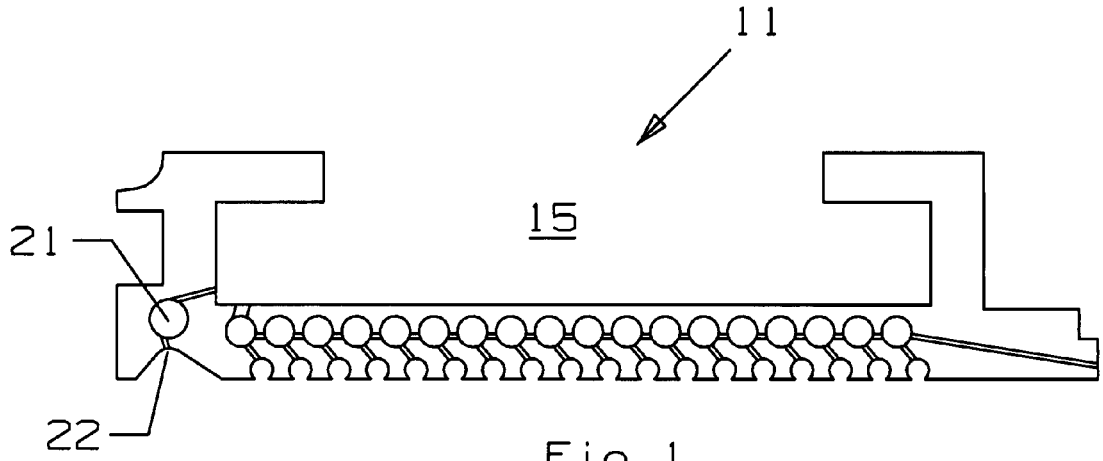
FIG. 1 shows a cross section view of the turbine blade tip shroud of the present invention.
Figure 2:
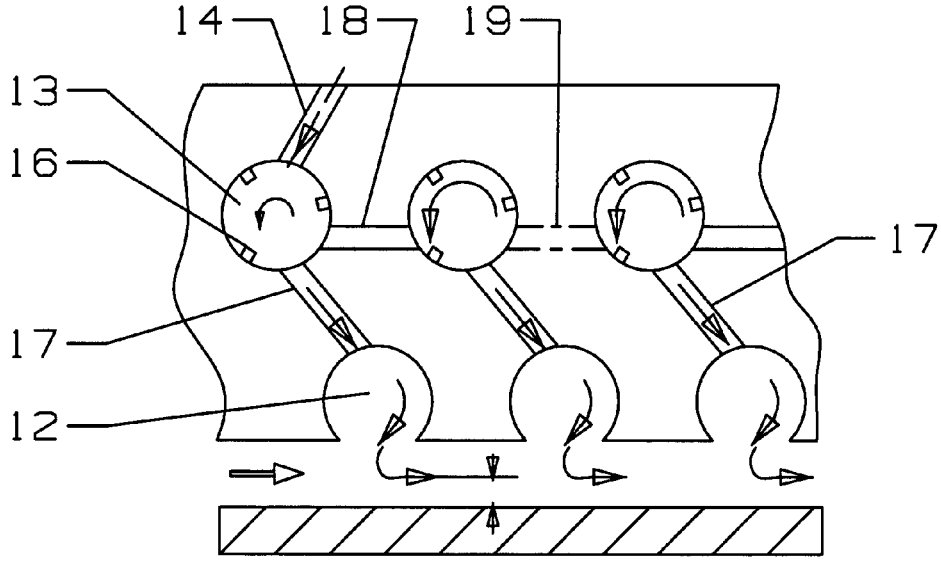
FIG. 2 shows a detailed cross section view of the first three of the vortex flow chambers and circular circumferential grooves of the present invention.
Figure 5:
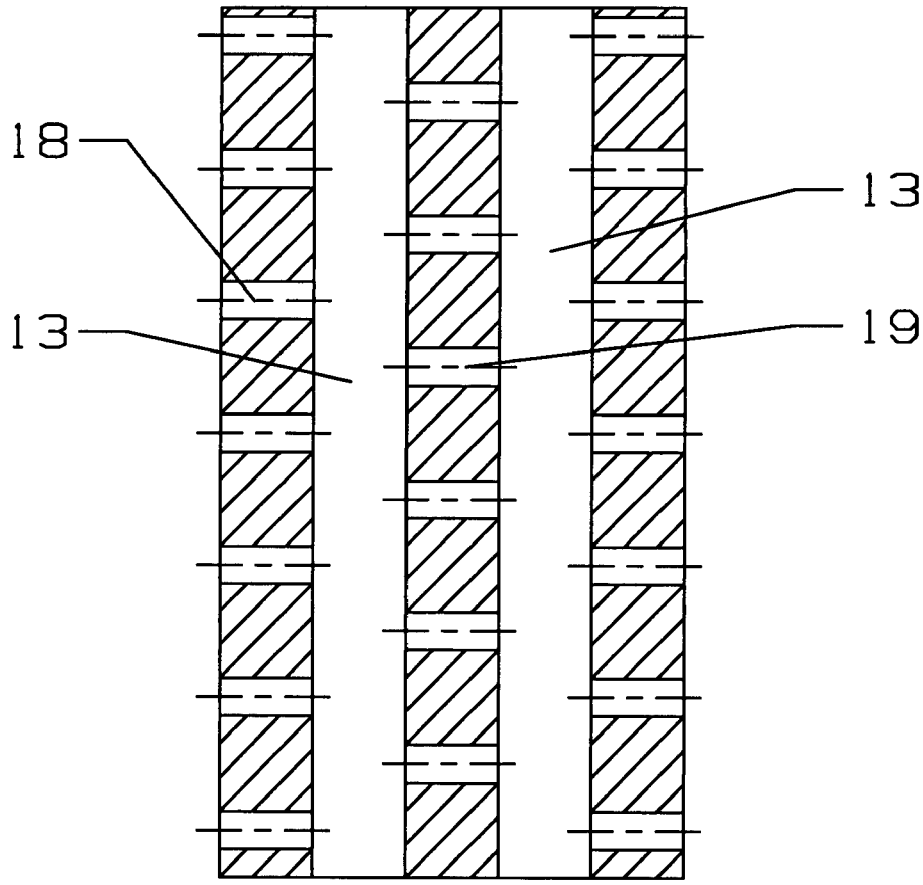
FIG. 5 shows a cross section view of the vortex chambers and the staggered inter-linking channels that connect adjacent chambers.

The present invention is a turbine blade tip shroud with a cooling circuit that produces improved cooling of the shroud and better sealing of the blade tip gap than the disclosed prior art designs. FIG. 1 shows a cross section view of the blade tip shroud 11 that is typically supported in the turbine by a pair of isolation rings. The shroud segment 11 includes hooks on the forward and aft ends that also form a cooling air supply cavity directly above the shroud segment. The inner surface of the shroud segment 11 includes a plurality of rows of circular circumferential grooves 12 that extend along the shroud surface in any of the prior art arrangements. FIG. 2 shows a detailed cross section view of the cooling circuit of the shroud. A vortex chamber 13 is located entirely within the shroud and between the top surface and the groove 11 in which one vortex chamber 13 is associated with one groove 12. A cooling feed slot 14 supplies cooling air from the cooling air supply cavity 15 into the vortex chamber 13 in such a direction that a vortex flow of the cooling air is produced within the vortex chamber 13. Trip strips 16 are also included within the vortex chambers 13 to promote heat transfer coefficient. A spent air discharge slot 17 connects the vortex chamber 13 to the associated circumferential groove 12 in such a location and direction to produce a cooling air flow within the groove as shown by the arrows in FIG. 2. Adjacent vortex chambers 13 are connected together by inter-linking channels 18 and 19 in which channel 18 is staggered with respect to channel 19 as seen best in FIG. 5. In each of the embodiments of the present invention, the vortex chambers and circular grooves with connecting holes or slots are formed within the shroud during the casting process that forms the shroud. The well known investment casting process used to form turbine airfoils is used.

In the FIG. 2 embodiment, three vortex chambers 13 are arranged side by side and are supplied by one cooling feed slot 14 connected to the first vortex chamber in the cooling air flow direction. The second vortex chamber is connected by the inter-linking channel 18 to the first vortex chamber, and the third vortex chamber is connected to the second vortex chamber by the inter-linking channel 19 that is staggered from the first channel 18. Each of the three vortex chambers 13 is connected to a circular circumferential groove 12 by a separate spent air discharge slot 17. This arrangement of three vortex chambers 13 and three grooves 12 is repeated along the shroud from the forward end to the aft end.

Also located on the forward end of the shroud is a leading edge vortex chamber 21 that is connected to the cooling air supply cavity 15 through an inlet hole and to a leading edge film slot 22 through an exit hole. Trip strips can also be used within the leading edge vortex chamber 21.

Cooling air is supplied through the blade ring carrier. For a series of vortex cooling chambers, the cooling air is fed into the first vortex chamber located in the backside of the blade tip shroud forward section first. The spent cooling air is then channeled into a series of multiple continuous vortex chambers. This spent cooling air is then channeled into the next vortex chamber through the inter-linking cooling slots which are arranged in a staggered array formation. As a result of the tangential injection of the cooling air into the vortex chambers, a high velocity of sidewall vortices is created within the continuous vortex chamber. The multiple vortex cooling process repeats throughout the entire inter-linked connecting of the continuous vortex chambers. Prior to injection into the next vortex chamber, a portion of the spent cooling air is bled off from each vortex chamber and discharged into the circular circumferential grooves to provide additional cooling and sealing for the blade tip shroud.

A small portion of the spent cooling air is finally discharged into the interface cavity between the BOAS and the downstream vane to provide additional film cooling for the downstream component or to function as purge air for the cavity. Peripheral cooling holes at staggered arrangement can also be used in the vortex chamber at both ends of the blade tip shroud. These peripheral cooling holes will provide cooling for the BOAS rail as well as purge air for the inter-segment cavity in-between the BOAS.

Figure 3:
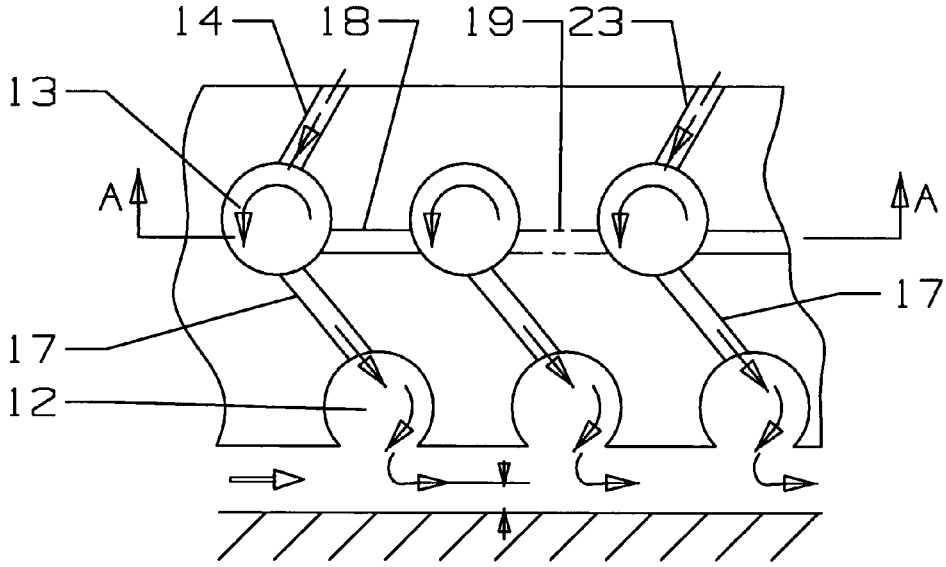
FIG. 3 shows a detailed cross section view of a second embodiment of the vortex cooling chambers of the present invention.

A second embodiment of the vortex chamber and circular groove cooling arrangement is shown in FIG. 3. The same arrangement of vortex chambers and circular grooves is produced with the cooling air feed holes and the spent air discharge slots and the inter-linking cooling air channels connecting as in the FIG. 2 embodiment. However, the FIG. 3 embodiment adds a cooling air re-supply hole 23 to the third vortex chamber in the series to supply additional cooling air from the supply cavity 15. As in the FIG. 2 embodiment, the inter-linking channels 18 and 19 are staggered. This vortex chamber series with associated circular grooves is repeated along the shroud from the forward end to the aft end. Also, the leading edge vortex chamber 21 and the leading edge film slot 22 cooling air circuit of the FIG. 1 embodiment is repeated for the second embodiment to provide cooling to the leading edge of the shroud.

Figure 4:
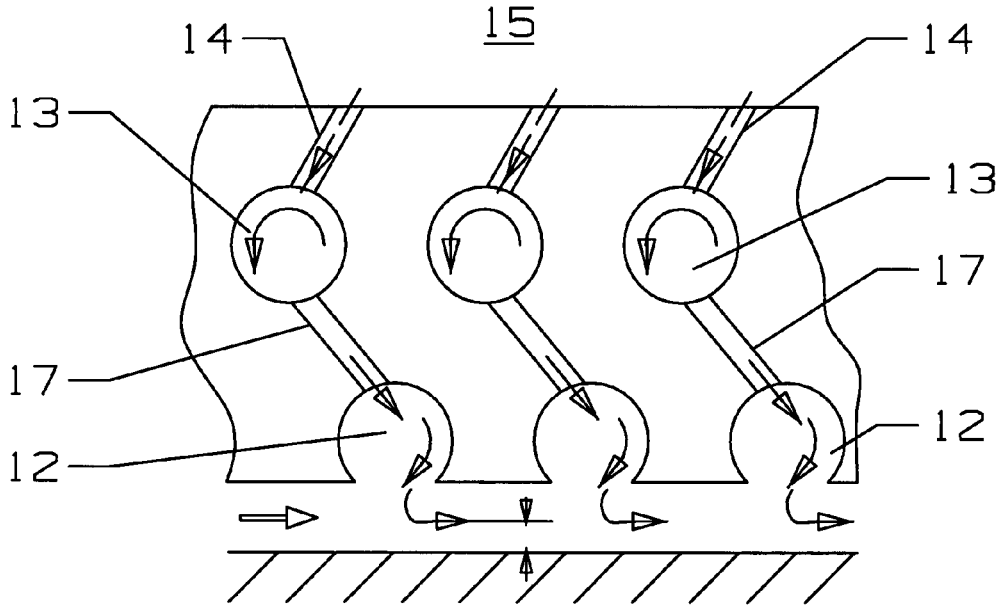
FIG. 4 shows a detailed cross section view of a third embodiment of the vortex cooling chambers of the present invention.

The third embodiment of the present invention is shown in FIG. 4 and includes a series of vortex chambers 13 connected to an associated circular groove 12 without any inter-linking channels connecting adjacent vortex chambers. Cooling air supplied through the feed hole 14 passes into the vortex chamber and then flows into the circular groove through the spent air discharge slot 17 in a series flow. This series of cooling air flow is repeated along the shroud from the forward end to the aft end without any inter-linking of the cooling air flow. The series of vortex chamber and circumferential groove cooling passages of FIG. 4 form independent cooling passages through the shroud since no cooling air flow from one series to the other series as in the first and second embodiments due to the inter-linking channels. The leading edge vortex chamber 21 and the leading edge film slot 22 cooling air circuit of the FIG. 1 embodiment is repeated for the third embodiment to provide cooling to the leading edge of the shroud. In the FIG. 4 embodiment, the local pressure and heat load requirements on the leading edge of the blade tip shroud can be controlled by the cooling air pressure and flow through the independent vortex and groove circuits along the shroud.

The combination effects of back side vortex cooling plus multiple circular circumferential grooves provides a very effective cooling and sealing arrangement for the blade outer air seal. The usage of cooling air is maximized for a given airfoil inlet gas temperature and pressure profile. Also, the multiple vortex cooling chambers generates a high coolant flow turbulence level and yields a higher internal convection cooling effectiveness plus leakage flow resistance by the use of the circular circumferential groove geometry. The cooling flow ejection from the curved grooves creates a very high resistance for the leakage flow path and thus reduces the blade leakage flow and improves the blade tip shroud cooling. As a result, the cooling circuit of the present invention reduces the blade tip shroud and blade tip section cooling flow requirement.

Major advantages of the sealing and cooling circuit of the present invention over the prior art BOAS cooling circuitry are described below. The uniqueness of the blade tip shroud geometry and cooling air ejection induces a very effective blade cooling and sealing for the blade tip shroud. Current blade cooling utilizes a series of cooling vortex chambers to provide convective cooling for the blade tip shroud first, and then discharges the cooling air as impingement as well as film cooling and sealing on the blade tip shroud external surface. This double use of the cooling air increases the overall blade cooling effectiveness. The blade tip shroud circular circumferential grooves reduce the hot gas side convection heat load area and generates more cooling side convective cooling surface which enhances the blade tip shroud cooling. Near wall circumferential cooling grooves utilized for the blade tip shroud reduces conduction thickness and increases BOAS overall heat transfer convection capability and thus reduces blade tip shroud surface and metal temperature. The cooling circuit increases the design flexibility to redistribute cooling flow and/or add cooling flow for each vortex chamber and therefore allows for the increasing growth potential for the cooling design. Each individual cooling vortex chamber can be independently designed based on the local heat load and aerodynamic pressure loading conditions. Lower blade tip shroud and blade tip section cooling air demand due to lower blade leakage flow translates into a lower heat load to these components. Higher turbine efficiency is obtained due to low blade leakage flow and cooling flow demand. Reduction of blade tip section heat load is obtained due to low leakage flow which also increases the blade useful life. The spent impingement cooling air is ejected at the forward and upward directions relative to the incoming leakage flow in the blade tip to shroud gap to create an effective mean leakage flow reduction. The acute corner for the forward flowing concave tip groove geometry creates a flow restriction for the incoming leakage flow and thus reduces the amount of leakage flow. The overall cooling system creates more convective cooling surface area than the external hot gas side heat load surface area alone.

I claim the following:

1. A blade tip shroud for a gas turbine engine comprising:
the blade tip shroud having a hot gas flow side and a cooling supply cavity side;
a row of circular circumferential grooves on the hot gas flow side;
a cooling air hole connected to each of the grooves; and,
the cooling air holes are oriented to discharge cooling air against the backside of the groove and the cooling air is discharged from the groove with a forward component direction opposed to the hot gas flow direction through the blade outer air seal.

2. The blade tip shroud of claim 1, and further comprising:
the grooves are parallel along the hot gas flow side of the shroud.

3. The blade tip shroud of claim 2, and further comprising:
the parallel grooves are sized and spaced to allow for blade tip rub to occur.

4. The blade tip shroud of claim 1, and further comprising:
the shroud is a shroud segment.

5. The blade tip shroud of claim 1, and further comprising:
a vortex chamber formed within the shroud for each of the grooves;
a spent air discharge slot connecting each of the grooves to the vortex chamber; and,
a cooling air supply means to supply cooling air to the vortex chambers such that a vortex flow forms within the vortex chambers.

6. The blade tip shroud of claim 5, and further comprising:
the cooling air supply means includes a cooling feed slot for a first vortex chamber and an inter-linking channel connecting the first vortex chamber to the second and adjacent vortex chamber.

7. The blade tip shroud of claim 6, and further comprising:
a third vortex chamber formed in the shroud and connected to the second vortex chamber by a second inter-linking channel that is staggered with respect to the first inter-linking channel.

8. The blade tip shroud of claim 7, and further comprising:
a re-supply cooling air hole connected to the third vortex chamber to supply additional cooling air to the third vortex chamber.

9. The blade tip shroud of claim 5, and further comprising:
the circumferential grooves and the vortex chambers forming parallel and independent cooling air passages through the shroud.

10. The blade tip shroud of claim 5, and further comprising:
the cooling air feed slots discharge cooling air into the vortex chamber toward the forward side of the chamber; and,
the spent air discharge slots discharge the cooling air against the backside of the groove.

11. The blade tip shroud of claim 5, and further comprising:
the vortex chambers include trip strips.

12. The blade tip shroud of claim 1, and further comprising:
a leading edge vortex chamber formed in the leading edge of the shroud;
a leading edge film slot on the hot gas flow side of the shroud; and,
a cooling air supply hole opening into the leading edge vortex chamber and a cooling air discharge hole opening into the leading edge film slot.

13. A blade tip shroud for a gas turbine engine comprising:
the blade tip shroud having a hot gas flow side and a cooling supply cavity side;
a row of grooves on the hot gas flow side;
a plurality of vortex chambers formed within the shroud;
a spent air discharge slot connecting each vortex chamber to a groove; and,
cooling air supply means to supply cooling air to the vortex chambers.

14. The blade tip shroud of claim 13, and further comprising:
a first vortex chamber connected to the cooling air supply cavity by a cooling feed slot;
the second vortex chamber connected to the first vortex chamber by an inter-linking channel such that cooling air supplied to the second vortex chamber flows through the first vortex chamber first.

15. The blade tip shroud of claim 14, and further comprising:
a third vortex chamber connected to the second vortex chamber by a second inter-linking channel that is staggered with respect to the first inter-linking channel.

16. The blade tip shroud of claim 15, and further comprising:
a cooling air re-supply hole connected to the third vortex chamber.

17. The blade tip shroud of claim 13, and further comprising:
each vortex chamber including a cooling air feed hole; and,
the grooves and the vortex chambers forming parallel and independent cooling air passages through the shroud.

18. The blade tip shroud of claim 13, and further comprising:
the grooves are circumferential circular grooves each with an aft end lip that directs the cooling air into the leakage flow with a forward direction flow component.

19. The blade tip shroud of claim 13, and further comprising:
the cooling air supply means discharges cooling air into the vortex chambers to form a vortex flow within the chambers.

20. The blade tip shroud of claim 13, and further comprising:

the cooling air supply means discharges cooling air into the vortex chambers to form a vortex flow within the chambers; and, the spent air discharge slots discharge cooling air from the vortex chambers against the backside wall of the circumferential circular grooves.

21. The blade tip shroud of claim 13, and further comprising:

a leading edge vortex chamber formed in the leading edge of the shroud;

a leading edge film slot on the hot gas flow side of the shroud; and, a cooling air supply hole opening into the leading edge vortex chamber and a cooling air discharge hole opening into the leading edge film slot.

22. A process for cooling and sealing a blade tip shroud in a gas turbine engine, the blade tip shroud forming a gap with a turbine rotor blade tip, the process comprising the steps of:

supplying pressurized cooling air to a cooling air cavity above a blade tip shroud segment;

passing cooling air into a plurality of vortex chambers formed within the shroud segment in a vortex flow;

discharging the cooling air from the vortex chambers into a row of grooves formed on the hot gas side surface of the shroud segment; and, discharging the cooling air from the grooves into a leakage flow with a forward flowing component.

23. The process for cooling and sealing a blade tip shroud of claim 22, and further comprising the step of:

passing cooling air from the supply air cavity into a leading edge chamber in a vortex flow; and, discharging the cooling air from the vortex flow chamber into a leading edge film slot on the hot gas flow surface of the shroud segment.

24. The process for cooling and sealing a blade tip shroud of claim 22, and further comprising the step of:

promoting turbulent flow of the cooling air within the vortex flow of the chambers.

25. The process for cooling and sealing a blade tip shroud of claim 22, and further comprising the step of:

passing cooling air from one vortex flow chamber into an adjacent vortex flow chamber.

26. The process for cooling and sealing a blade tip shroud of claim 25, and further comprising the step of:

re-supplying a second vortex flow chamber with cooling air from the cooling air cavity.

* * * * *